US007226370B1

(12) United States Patent
Cope

(10) Patent No.: US 7,226,370 B1
(45) Date of Patent: Jun. 5, 2007

(54) GOLF BALL POSITION MARKER ASSEMBLY

(76) Inventor: Jeffrey L. Cope, 423 Goldfinch Dr., Augusta, GA (US) 30907

( * ) Notice: Subject to any disclaimer, the term of this patent is extended or adjusted under 35 U.S.C. 154(b) by 0 days.

(21) Appl. No.: 10/989,836

(22) Filed: Nov. 15, 2004

Related U.S. Application Data

(60) Continuation-in-part of application No. 10/418,971, filed on Sep. 2, 2003, now Pat. No. 6,984,183, which is a division of application No. 09/834,871, filed on Apr. 12, 2001, now Pat. No. 6,569,039, which is a continuation-in-part of application No. 09/552,388, filed on Apr. 19, 2000, now abandoned, and a continuation-in-part of application No. 09/409,325, filed on Sep. 30, 1999, now abandoned, application No. 10/989,836, which is a continuation-in-part of application No. 10/919,038, filed on Aug. 16, 2004.

(60) Provisional application No. 60/130,246, filed on Apr. 19, 1999, provisional application No. 60/102,617, filed on Oct. 1, 1998.

(51) Int. Cl.
*A63B 57/00* (2006.01)

(52) U.S. Cl. ..... 473/406

(58) Field of Classification Search ..... 473/406, 473/408; 224/918
See application file for complete search history.

(56) References Cited

U.S. PATENT DOCUMENTS 3,136,547 A 6/1964 Schaper
3,139,690 A 7/1964 Hait
3,208,123 A 9/1965 Koos
3,233,802 A 2/1966 Ludwick
3,298,579 A * 1/1967 Smith ..... 224/918
3,339,300 A 9/1967 Bury
3,415,518 A * 12/1968 Root ..... 473/406
3,620,426 A 11/1971 Hatch
3,744,542 A * 7/1973 Stephens et al. ..... 224/918
4,007,928 A 2/1977 Doubt
4,081,114 A * 3/1978 Inoue ..... 224/918
4,475,676 A 10/1984 Smith
4,530,500 A 7/1985 Kaymen
4,573,610 A * 3/1986 Hurner ..... 224/918
5,135,220 A 8/1992 Baldoni
5,160,134 A 11/1992 McDonald
5,282,616 A 2/1994 Stacavich-Notaro
5,305,999 A * 4/1994 Tate ..... 473/406
5,569,103 A 10/1996 Sihn
5,782,708 A * 7/1998 Kimball, Jr. ..... 473/408
5,996,116 A 12/1999 Tate (Continued)

*Primary Examiner*—Steven Wong
(74) *Attorney, Agent, or Firm*—Jason A. Bernstein; Charles L. Warner, II; Powell Goldstein LLP

(57) ABSTRACT

A golf ball position marking assembly that includes a marker removably secured to a decorative or functional accessory item such as a ring, pendant, clip, belt, key ring, bracelet, buckle, divot tool, or the like. The marker is magnetically secured to a base in such a way that a golfer can quickly and easily detach it to mark the position of a golf ball, and as easily re-attach it when the time comes to play. The assembly is made of any suitable material, including plastics, metals, ceramics, and composites. If desired, it can include decorative or functional indicia such as precious stones, decorative etching or enameled ornamentation, the user's name or initials, memorable dates, advertising material, tournament logos, or golf club logos.

2 Claims, 10 Drawing Sheets

U.S. PATENT DOCUMENTS 6,033,322 A * 3/2000 England ..... 473/408
6,163,889 A 12/2000 Tate
6,253,974 B1 * 7/2001 Park ..... 224/918
6,273,279 B1 8/2001 Wolf
6,569,039 B1 5/2003 Cope
6,966,851 B1 * 11/2005 England et al. ..... 473/406

* cited by examiner

GOLF BALL POSITION MARKER ASSEMBLY

PRIORITY CLAIM

This application is a continuation-in-part of U.S. patent application Ser. No. 10/418,971, filed Sep. 2, 2003, now U.S. Pat. No. 6,984,183, which is a division of U.S. patent application Ser. No. 09/834,871, filed Apr. 12, 2001, now U.S. Pat. No. 6,569,039, which is a continuation-in-part of U.S. patent application Ser. No. 09/552,388, filed on Apr. 19, 2000, now abandoned, and a continuation-in-part of U.S. patent application Ser. No. 09/409,325, filed Sep. 30, 1999, now abandoned, which Ser. No. 09/552,388 claims the priority of U.S. Provisional Patent Application Ser. No. 60/130,246, filed Apr. 19, 1999, and which Ser. No. 09/409,325 claims the priority of U.S. Provisional Patent Application Ser. No. 60/102,617, filed on Oct. 1, 1998. This application is also a continuation-in-pat of U.S. patent application Ser. No. 10/919,038 filed Aug. 16, 2004. The entirety of each of the above is hereby incorporated herein by reference.

BACKGROUND OF THE INVENTION

1. Field of the Invention

The present invention relates to a golf ball position marker assembly that includes a wearable or nonwearable accessory item such as a ring, pin, belt buckle, golf bag or glove, key ring, divot tool, clip, or the like. In particular, the present invention relates to a golf ball position marker assembly wherein a ball marker is quickly and easily attached to an accessory item, and as quickly removed therefrom for use.

2. Discussion of Background

During a golf game, a golfer must sometimes move his or her ball aside to permit another golfer to putt. On these occasions, the golfer who moves a ball places a marker on the green to identify the original position of the ball so that it can be replaced in the same spot. Many golfers use whatever small items they happen to have available as ball markers, including coins, buttons, and the like; others prefer special marking devices that can be stored with other golf equipment or attached to their clothing. For purposes of this specification, the terms "golf ball position marker," "position marker," "ball marker," "marker" and the like are used interchangeably to refer to any device used to mark the position of a golf ball. Typical markers are generally flat, disc-like objects; some have posts that project a short distance into the soil when the marker is in use.

Many different types of golf ball markers are available, some of which are combined with other tools useful to golfers (clocks, compasses, wind indicators, divot repair tools, and so forth). Several devices include permanent magnets for securing a marker when it is not in use. For example, Balloon's golf ball position marker apparatus consists of a ferrous metallic disc mounted to a magnetized housing, which in turn is mounted to a wrist strap, spring clip, or post mount (U.S. Pat. No. 5,135,220). The housing may also include a wind indicator.

Cayman discloses a golf ball position marker and storage device that can be worn on a waistband (U.S. Pat. No. 4,530,500). This device includes a plastic or metal clip, a magnet with an outwardly-projecting knob affixed to the front of the clip, and a removable, magnetized marker with a central throughhole that fits over the knob for storage when not in use. The marker is larger than the magnet, thus, the user can easily grasp the edges of the marker to pull it away from the magnet.

Ludwick shows a combined golf ball position marker and carrier which includes a belt clip (U.S. Pat. No. 3,233,802). The carrier is molded of high-density polyethylene or polystyrene and has two recessed areas in the front, each recess containing a magnet and partially surrounded by a shallow rim. The recesses hold markers made of a magnetic material such as zinc iron alloy. In U.S. Pat. No. 3,208,123), Koos discloses a belt buckle with a magnetic element for holding a golf ball marker. The buckle may also have ornamental features such as crossed golf clubs that are provided for aesthetic appeal.

Hait's golfing aid consists of a pin with a magnet for holding a marking device. The marking device itself is preferably a stainless steel disc which can be engraved with the owner's initials or some other decorative features (U.S. Pat. No. 3,139,690). Schaper discloses a belt buckle with a recess for a permanent magnet that secures a marker in position (U.S. Pat. No. 3,136,547). The marker itself is formed with a peripheral flange that helps prevent it from slipping off the face of the magnet.

Fazekas provides a multi-purpose golf tool with a recess for holding a ball marker (U.S. Pat. No. 5,733,208). A raised magnetic post in the center of the recess holds the marker in position. By pushing down on one edge of the marker, the user tilts and lifts the marker up over the edge of the recess to slide it forward into position. Suzuki's golf ball position mark assembly includes a permanent magnet; the marker has a projection to assist the user in removing it for use, and also to fix it on the ground (U.S. Pat. No. 3,923,215).

Devices with storage for two markers are also known. Tate shows such a device, which has two separate magnet-containing recesses for two equally-sized markers (U.S. Pat. No. 5,305,999). The magnets occupy less than the entire peripheral areas of their respective recesses, thus, pressing the edge of a marker tilts the opposing edge out of its recess. The marker may have a central post that fits into a corresponding aperture in the magnet (U.S. Pat. No. 5,295,683). Buckman's device has two magnet-containing recesses on opposing sides of a ground repair tool (U.S. Pat. No. 4,315,624).

Markers have been attached to golf equipment such as putters. For example, Bayer's putter has includes magnets, a recess dimensioned for holding a marker made of magnetized material, and an opening in the bottom surface that is slightly smaller than the diameter of a golf ball (U.S. Pat. No. 5,417,426). When a ball enters the opening, it trips the marker from the magnet, causing the marker to fall out and mark the position of the ball. Kepler shows a tournament-type putter with a marker and a ball retrieval-retainer structure that allows the user to pick up balls without bending over (U.S. Pat. No. 4,248,430).

Another type of device has holes or slots dimensioned for receiving the post of a marker. For example, McDonald's combined golf green repair tool and timepiece includes peripheral holes for attaching items such as a keychain and ball marker (U.S. Pat. No. 5,160,134). The back of the timepiece is attached to the central portion of the tool, above the tines; the marker is inserted into one of the peripheral holes. Smith provides a golf marker and tee caddy consisting of an S-shaped clip with slots for holding markers and tongues for holding golf tees (U.S. Pat. No. 4,475,676). This device can be clipped onto a golf bag or the user's clothing (lapel, waistband, etc.)

Markers can be combined with divot tools or other devices useful to golfers, as shown by Tate (U.S. Pat. No. 5,295,683). Here, a divot tool is formed with a shallow, concave ball marker seat that contains a disk of magnetic material having a central opening. A ball marker can be removably seated on top of the magnetic material, with the marker post (if present) extending through the opening.

Doubt (U.S. Pat. No. 4,007,928) shows a golfer's combination tool which can be used as a shoe horn, divot repair device, and a prop for a golf club when the user wishes to keep the handle away from the ground. The device includes a small center hole into which the user can insert a standard golf ball marker. Hatch (U.S. Pat. No. 3,620,426) discloses a combination golf green repair tool and ball marker with a carrier. His device consists of a flat body member with a handle at one end and prongs at the other end, a hole for inserting a marker, and a carrier with a spring clip that can be attached to a pocket or belt. The stem of the marker may be mounted via a rubber grommet. Bury's detachable mountable pendent has a horseshoe-shaped clamp designed for holding tokens, cards, discs, etc. as well as golf ball markers (U.S. Pat. No. 3,339,300). The inside edge of the clamp is formed with a groove into which the user can slide a disc-shaped object such as a marker. The device can be attached to the user's clothing with a clip.

Position markers can be attached to jewelry items such as tie tacks and bracelets. For example, Balloon's magnetic marker (described above) can be attached to a post mount. Stacavich-Notaro's golf ball marker, described in U.S. Pat. No. 5,282,616 has a hook-and-loop material (VELCRO or the like) on the bottom surface so that the marker can be attached to a disk that has a top surface covered with a mating hook-and-loop material. The device can be attached to a golf club shaft or a tie tack. Furin (U.S. Pat. No. D252,289) shows a golf ball marker band in the form of a bracelet.

Sihn's golf ball marker carries a variety of decorative elements such as gems, engraved initials, etc. (U.S. Pat. No. 5,569,103). The bottom of the marker includes a rounded stud that allows the user to secure the marker to a golf glove, lapel button hole or the like; the stud also helps secure the marker in position on a green.

My provisional application Ser. No. 60/130,246, shows a device wherein at least one position marker is magnetically attached to the accessory item in such a way that a golfer can quickly and easily slide it from the item to mark the position of a golf ball, and as easily re-attach it to the item when the time comes to play the ball and move on. The magnets are positioned so that a golfer can operate the device with one hand: to dislodge a marker from the device, he simply taps the device against a convenient object (or releases it with his thumbnail), then slides it off and positions it on the green.

Golf ball position markers are preferably quite small in size (generally no larger than a quarter), light in weight, easy to carry, and easy to handle. Due to their small size, markers are easy to overlook and therefore easy to lose. Thus, a useful marker should be readily visible when placed on a green. Visibility is also desirable since stepping on or walking across the line of another golfer's putt to the hole is considered to be a breech of etiquette. Despite the wide variety of markers that are available to golfers, there is a continuing need for a practical, aesthetically pleasing position marking device that is easy to attach to—and equally easy to remove from—a decorative or functional accessory such as a ring, tie tack, bracelet, key holder, belt buckle, divot tool, clip, or the like.

SUMMARY OF THE INVENTION

The present invention provides a golf ball position marking assembly that carries at least one golf ball position marker removably secured to a fastener which may be carried by an accessory item. The ball marker is magnetically attached to the accessory item in such a way that a golfer can quickly and easily detach and use it to mark the position of a golf ball, and as easily retrieve and re-attach it when the time comes to play the ball.

One aspect of the present invention provides a fastener which secures the marker to the accessory item. The fastener may be a magnetized seat for holding markers made of magnetized metal, and may also include a throughhole for securing post-type markers or removing disk-type markers. Alternatively, the fastener may be a metal seat that secures a removable magnet which holds the marker.

Another aspect of the present invention provides an accessory item, which may be any selected decorative or functional article including but not limited to a clip, pendant, bracelet, pin, watchband, ring, hatband ornament, belt buckle or money clip, divot repair tool, or key ring. The present invention is envisioned as being used with wearable items and items that can be attached to clothing (shirts, jackets, trousers or skirts, golf gloves and golf shoes, belts and belt loops, jewelry, hatbands, etc.), and with non-wearable articles such as golf bags, golf clubs, tote bags, golf carts, and so forth.

Another aspect of the present invention provides versatility. A golf ball position marking assembly according to the invention may include a wide range of wearable and non-wearable accessory items, and the components of the assembly can be made of virtually any desired material. By way of example, a pendant or charm formed for carrying the ball marker can be made of base or precious metals, ceramics, composite materials, or durable plastics such as LUCITE™ and PLEXIGLAS™. A marker used with the invention can itself can be made of gold, silver, or other metal, or take the form of a favorite coin, golf club token, or other suitably-dimensioned item. The marking assembly (or markers used therewith) can include decorative or functional indicia such as precious or semiprecious stones, decorative etchings or enameled ornamentation, small coins, the user's name or initials, memorable dates, tournament logos, or golf club logos. When decorated with club or tournament logos, the invention is a collectible item such as the special logo balls that are prized by many golfers.

Another aspect of the present invention provides a golf ball position marking assembly which has a body and an insert. The body has a top section and a bottom section attached to the top section. The insert is at least one of a magnet or a magnetic material which is enclosed by the top section and the bottom section. The marker is at least one of a magnet or a magnetic material so as to be attracted to the insert, so that the marker is held against the body by the insert but is easily removable when desired.

Another aspect of the present invention provides that the top section of the golf ball position marking assembly includes a first surface and a support having a second surface, the second surface is higher than the first surface, with the insert at least partially beneath the second surface, and the marker is removably held against the second surface by the insert.

Another aspect of the present invention provides that the top section of the golf ball position marking assembly includes a first surface, a support having a second surface, and a recess beneath the second surface, the second surface is higher than the first surface, the insert is at least partially within the recess, and the marker is removably held against the second surface by the insert.

Another aspect of the present invention provides that the top section of the golf ball position marking assembly includes a first surface and a support having a second surface, the second surface is higher than the first surface, the insert is at least partially beneath the second surface, and the marker is removably held against the second surface by the insert, and the bottom section includes a support having a first surface, and a second surface, the second surface of the bottom section is higher than the first surface of the bottom section, and the insert is also at least partially above the second surface of the bottom section.

Another aspect of the present invention provides that the top section of the golf ball position marking assembly includes a first surface, a support having a second surface, and a recess beneath the second surface, the second surface is higher than the first surface, the insert is at least partially within the recess, and the marker is removably held against the second surface by the insert, and the bottom section includes a support having a first surface, and a second surface, the second surface is higher than the first surface, and the insert also is at least partially above the second surface of the bottom section.

Another aspect of the present invention provides that the top section of the golf ball position marking assembly includes a first surface and a second surface, the second surface is lower than the first surface to form a recess, the insert is at least partially beneath the second surface, and the marker is removably held at least partially within the recess by the insert.

Another aspect of the present invention provides that the top section of the golf ball position marking assembly includes a first surface, a second surface and a first recess beneath the second surface, the second surface is lower than the first surface to form a second recess, the insert is at least partially within the first recess, and the marker is removably held at least partially within the second recess by the insert.

Another aspect of the present invention provides that the top section of the golf ball position marking assembly includes a first surface and a second surface, the second surface is lower than the first surface to form a recess, and the marker is removably held at least partially within the recess by the insert, and the bottom section includes a first surface and a second surface, the second surface is lower than the first surface to form a recess, and the insert is at least partially within the recess in the bottom section.

Another aspect of the present invention provides that the top section of the golf ball position marking assembly includes a first surface, a second surface and a first recess beneath the second surface, the second surface is lower than the first surface to form a second recess, and the marker is removably held at least partially within the recess by the insert, and the bottom section includes a first surface, and a second surface, the second surface is lower than the first surface to form a recess, and the insert is at least partially within the first recess of the top section and at least partially within the recess of the bottom section.

Another aspect of the present invention provides that the top section of the golf ball position marking assembly includes a first surface and a second surface, the second surface is lower than the first surface and extending to an edge of the top section so that the first surface defines shoulders about a portion, but not all, of the second surface, the insert is at least partially beneath the second surface, and the marker is removably held against the second surface and the interior of the shoulders by the insert.

Another aspect of the present invention provides that the top section of the golf ball position marking assembly includes a first surface and a second surface, the second surface is lower than the first surface and extending to an edge of the top section so that the first surface defines shoulders about a portion, but not all, of the second surface, and the marker is removably held against the second surface and the interior of the shoulders by the insert, and the bottom section includes a first surface and a second surface, the second surface is lower than the first surface to form a recess, and the insert is at least partially within the recess in the bottom section.

Another aspect of the present invention provides that the top section of the golf ball position marking assembly includes a first surface, a second surface, and a recess beneath the second surface, the second surface is lower than the first surface and extending to one edge of the top section so that the first surface defines shoulders about a portion, but not all, of the second surface, and the marker is removably held against the second surface and the interior of the shoulders by the insert, and the bottom section includes a first surface and a second surface, the second surface is lower than the first surface to form a recess, and the insert is at least partially within the recess of the top section and the recess of the bottom section.

Another aspect of the present invention provides that the top section of the golf ball position marking assembly includes a first surface, a second surface, the second surface is lower than the first surface to form a recess, and a third surface which is lower than the first surface and is higher than the second surface to form a ledge within the recess, and the marker is removably held at least partially within the recess and against the ledge by the insert.

Another aspect of the present invention provides that the top section of the golf ball position marking assembly includes a first surface, a second surface, the second surface is lower than the first surface to form a first recess, a third surface which is lower than the first surface and is higher than the second surface to form a ledge within the first recess, and a second recess beneath the second surface, the insert is at least partially within the second recess, and the marker is removably held at least partially within the first recess and against the ledge by the insert.

The present invention also provides a golf ball position marking assembly which has a body and an insert. The body has a first surface, a second surface which is lower than the first surface to form a first recess, a third surface which is lower than the first surface and is higher than the second surface to form a ledge within the first recess, and a fourth surface which is lower than the third surface to form a second recess. The insert is held at least partially within the second recess. The marker is removably held at least partially within the first recess and against the ledge by the insert.

The present invention also provides a golf ball position marking assembly which has a body, a retainer, and a subcarrier assembly. The body has a top section and a bottom section attached to the top section, the top section includes a first surface, a support having a second surface, the second surface is higher than the first surface, a recess beneath the second surface, and a hole connecting the second surface to the recess, and the bottom section includes a first surface and a support having a second surface, the second surface is higher than the first surface, the support having a hole of a predetermined depth defined therein. The retainer is at least partially within the recess and also is at least partially above the second surface of the bottom section, the retainer having a hole defined therein which extends through the retainer. The subcarrier assembly has a subcarrier and an insert, the subcarrier having a recess in the top surface and a post of a predetermined length extending from the bottom of the subcarrier. The insert is at least one of a magnet or a magnetic material and is held at least partially within the recess of the subcarrier. The marker is at least one of a magnet or a magnetic material so as to be attracted to the insert and is removably held against the subcarrier assembly by the insert. The post goes through the hole connecting the second surface to the recess, through the hole in the retainer, and at least into the hole in the support, and the retainer grips the post to hold the subcarrier assembly to the body.

Another aspect of the present invention provides that, if an object is to be attached to the golf ball position marking assembly and the object has a hole therein for attachment, then the height of the support is selected to accommodate the depth of the object, and at least one of the radius and shape of the support are selected to allow the support to go into the hole in the object.

Another aspect of the present invention provides that, if an object is to be attached to the golf ball position marking assembly and the object has a hole therein for attachment, then the height of the support is selected to accommodate the depth of the object, and at least one of the radius and shape of the support are selected to allow the support to go into the hole in the object, and at least of the radius and shape of the subcarrier are selected to hold at least part of the object between the subcarrier and the body.

The present invention also provides a golf ball position marking assembly which has a body, a retainer, and a subcarrier assembly. The body has a top section and a bottom section attached to the top section, the top section includes a first surface, a second surface, the second surface being lower than the first surface to form a first recess, a second recess beneath the second surface, and a hole connecting the first recess to the second recess, and the bottom section includes an inner surface, a bottom surface, and a hole connecting the inner surface to the bottom surface. The retainer is at least partially within the recess and has a hole defined therein which extends through the retainer. The subcarrier assembly includes a subcarrier and an insert, the subcarrier includes a recess in the top surface, and has a post of a predetermined length extending from the bottom of the subcarrier. The insert is at least one of a magnet or a magnetic material and is held at least partially within the recess of the subcarrier. The marker is at least one of a magnet or a magnetic material so as to be attracted to the insert, the marker being removably held against the subcarrier assembly by the insert. The post goes through the hole connecting the first recess to the second recess, through the hole in the retainer, and at least into the hole in the bottom section, and the retainer grips the post to hold the subcarrier assembly to the body.

Another aspect of the present invention provides that the bottom section further includes a concave area surrounding the hole through the bottom surface to allow the post of the subcarrier to be pushed upward to loosen the subcarrier from the body.

The present invention also provides that the bottom section of a golf ball position marking assembly may include an extended area having a hole defined therein for removably attaching the golf ball position marking assembly to a desired object.

The present invention also provides that the top section and the bottom section may define a groove at their exterior intersection.

The present invention also provides that where the top section and the bottom section define a groove at their exterior intersection there may also be a clip, at least a portion of which is located within the groove, the clip being to attach the golf ball position marking assembly to a desired object.

The present invention also provides that where the top section and the bottom section define a groove at their exterior intersection there may also be a clip, at least a portion of which is located within the groove, the clip being a shower ring to attach the golf ball position marking assembly to a desired object.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1A:
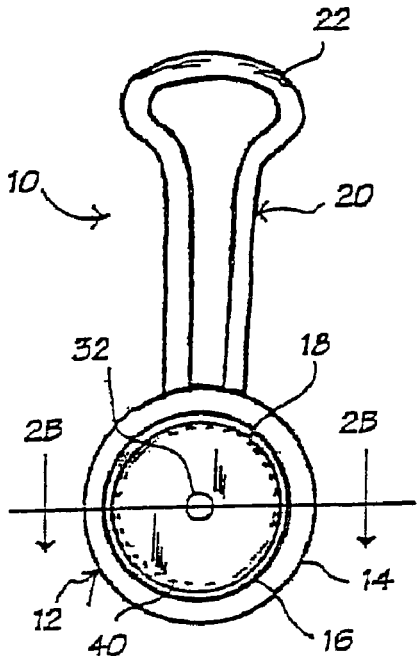
FIGS. 1A and 1B are front and back views, respectively, of a golf ball position marker assembly according to a preferred embodiment of the present invention.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. Section 112. As used herein, the terms "horizontal," "vertical," "left," "right," "up," "down," as well as adjectival and adverbial derivatives thereof, refer to the relative orientation of the illustrated structure as the particular drawing figure faces the reader.

Figure 1B:
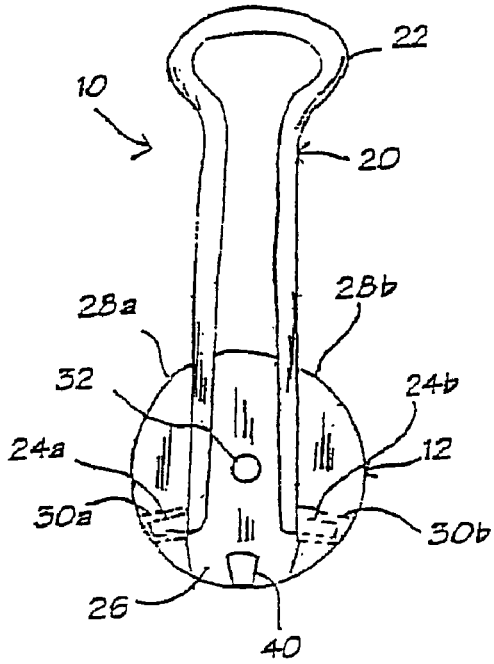
Figure 1C:
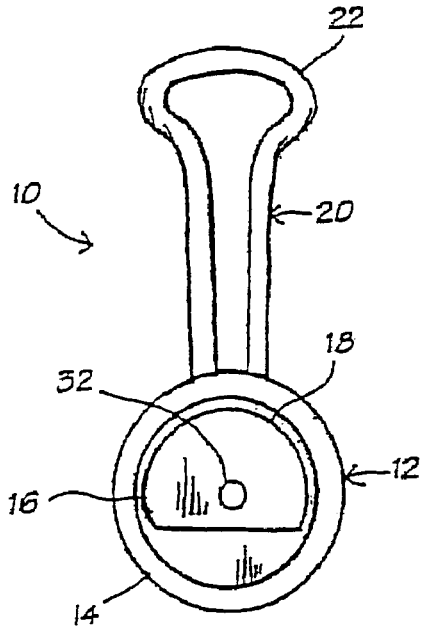
FIG. 1C is a front view of the assembly of FIG. 1A, showing an alternative magnetic insert.

Referring now to FIGS. 1A–C, there is shown a golf ball position marker assembly 10 according to a preferred embodiment of the present invention. Assembly 10 includes a retainer for holding a ball marker, in the form of a body 12 with full or partial rim 14 about a recessed base 16 on the front side of body 12, a magnetized insert 18 at least partially covering base 16, and a generally U-shaped clip 20 with a loop 22 and outwardly-projecting end portions 24*a*, 24*b*. The back side of base 16 (FIG. 1B) has formed therein a recess 26 between sections 28*a*, 28*b*, with channels 30*a*, 30*b* for receiving ends 24*a*, 24*b* of clip 20, generally as shown. A central throughhole 32 may extend through insert 18 and base 16.

Figure 2A:
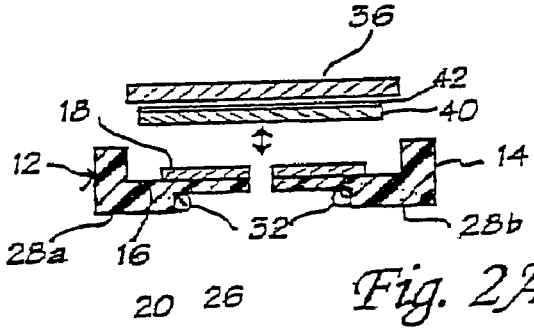
FIG. 2A is a cross-sectional view of the body of the assembly of FIG. 1A, taken along the lines 2B—2B of FIG. 1A.
Figure 2B:
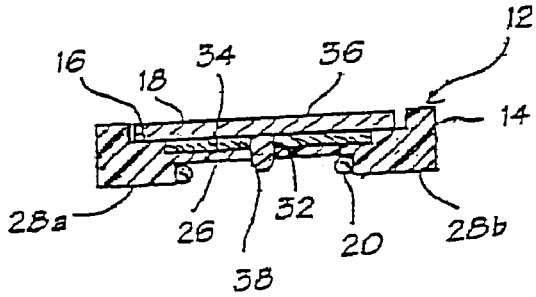
FIG. 2B shows the assembly of FIG. 2A with an alternative magnetic insert.

Insert 18 may be mounted to the surface of base 16 (FIG. 2A), or be placed in a suitably-dimensioned recess 34 (FIG. 2B). When installed on recessed base 16, a disc-shaped ball marker 36 is held securely in position by insert 18. Insert 18 may substantially cover base 16 as shown in FIG. 1A, or partially cover the base as shown in FIG. 1C. It has been found that assembly 10 is especially easy to manipulate when used with an insert 18 of this latter type, that is, an insert that is somewhat smaller than a typical ball marker. Insert 18, when present, is generally flat, disc-shaped, or ring-shaped. However, other configurations may also be useful for the practice of the invention.

As noted above, insert 18 at least partially covers base 16. Insert 18 may be approximately circular as shown in FIG. 1A, partial-circular as shown in FIG. 1C, or indeed any other desired shape. The optimum dimensions of insert 18 depend on the particular material selected for the insert and the size and weight of marker 36 to be used therewith. Thus, the optimum dimensions (width, thickness, overall shape) of insert 18 are best selected by a modest degree of experimentation in view of the materials used for manufacturing assembly 10.

Alternatively, insert 18 may be a nonmagnetized metal disc that holds a removable magnet 40 (FIGS. 1A and 2A). In this embodiment of the invention, insert 18 is a metal disc that at least partially covers base 16. Insert 18 may be press-fitted into a suitable recess in base 16, attached to the base by any suitable adhesive, or molded or assembled within the base. Magnet 40 can be of any size that fits base 16 and securely holds a ball marker. Magnetized or non-magnetized inserts 18 can be used with any of the embodiment of the invention described herein, as may be preferred. Magnet 40 may be coated on one or both sides with TEFLON™ or other suitable coating, for example, a coating 42 as shown in FIG. 2A. Coating 42 may be applied by painting, spraying, dipping, or other suitable technique. An assembly 10 that includes a throughhole 32 can be used with the type of ball marker having a post on one side. Preferably, throughhole 32 has a diameter such that, when assembly 10 is used with a post-type marker, the post fits snugly within the throughhole so that the ball marker can be securely held in position with an exposed end of a post 38 projecting somewhat beyond body 12 (FIG. 2B). These types of markers can be either magnetic or non-magnetic, thus, insert 18 may be optional for an assembly 10 used solely with post-type, nonmagnetic ball markers. However, insert 18 is present when assembly 10 is intended for use with metal disc-type ball markers such as marker 36 shown in FIG. 2A.

Clip 20 is preferably made of a somewhat springy or resilient material, allowing the user to remove the clip from body 12 simply by compressing ends 24*a*, 24*b* together and withdrawing the ends from channels 30*a*, 30*b*. In addition, clip 20 can be rotated by 180 degrees, if desired. Assembly 10 can be used as a paper clip, bookmark or the like; alternatively, assembly 10 can be clipped to a belt, waistband, or hatband, or worn as a pendant. If desired, assembly 10 may include a hook 40 (FIG. 1B).

Figure 3A:
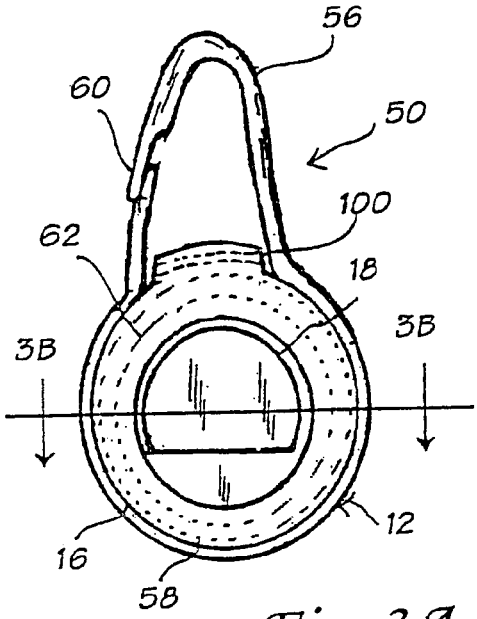
FIG. 3A is a front view of another golf ball position marker assembly according to a preferred embodiment of the present invention.
Figure 3B:
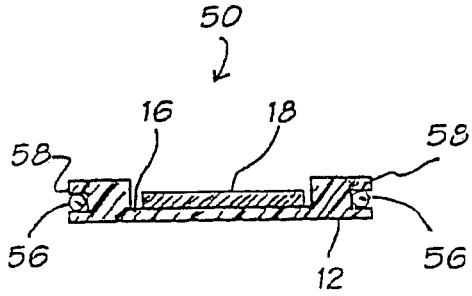
FIG. 3B is a cross-sectional view of the assembly of FIG. 3A, taken along the line 3B—3B of FIG. 3A.

Another golf ball position marker assembly 50 according to the invention includes a body 12 with a rim 14 about a base 16, a magnetized insert 18 of any convenient size and shape, and a clip 56 fitted in a generally circumferential channel 58 about the perimeter of body 12 (FIGS. 3A and 3B). Body 12 may include an optional enlarged portion 100 that serves as a stop for limiting rotation of body 12 on clip 56; portion 54 may carry decorative or functional indicia if desired. Portion 54 may include a throughhole 100 into which clip 65 or a chain (not shown) may be inserted.

Clip 56 may be fixed in position in channel 58; however, in a preferred embodiment of the invention, body 12 rotates freely on the clip, limited only by portion 54 (if present). Clip 56 is preferably a type of clip that can be readily opened and closed via a catch 60, such as the types of clips used to hold keys and the like. Like above-described clip 20, clip 56 is made of a somewhat springy, resilient material, preferably metal.

Assembly 50 may include a magnetized insert 18 that partially covers base 16 as shown in FIG. 3A; alternatively, an insert 18 such as that shown in FIG. 1A may be used if preferred. Insert 18 may include a throughhole 32 for use with post-type ball markers. Insert 18 may be mounted to the surface of base 16 as shown in FIG. 2A above, or in a recess such as recess 34 (FIG. 2B). If desired, a second recess 62 of any convenient diameter may be formed in the back of assembly 50. Second recess 62, if present, may be used for holding a second, post-type ball marker (not shown) while a first, disc-type ball marker is installed on insert 18. Above-described assembly 10 may also be fitted with a second recess 62 if desired.

Figure 3C:
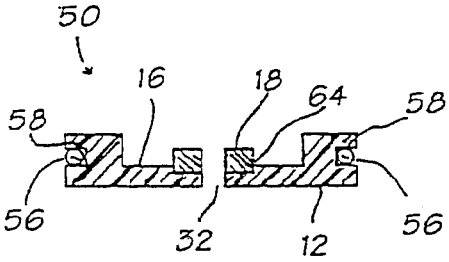
FIGS. 3C and 3D are cross-sectional views of additional embodiments of the golf ball position marker assembly of FIG. 3A.
Figure 3D:
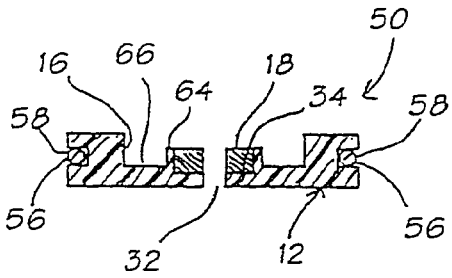

Additional configurations of insert 18 may also be useful. For example, insert 18 may be a somewhat smaller, ring-type magnet mounted in a recess 34 (FIG. 3C). Alternatively, recess 16 may include a raised shoulder 64 defining recess 34 and a second recess 66 (FIG. 3D). Insert 18 is placed in second recess 66, press-fitted in place or secured in position by a suitable adhesive.

Figure 4:
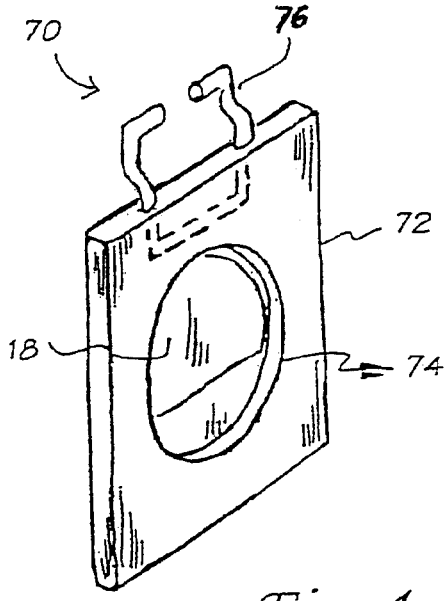
FIGS. 4 and 5 illustrate additional golf ball marker assemblies according to the present invention.
Figure 5:
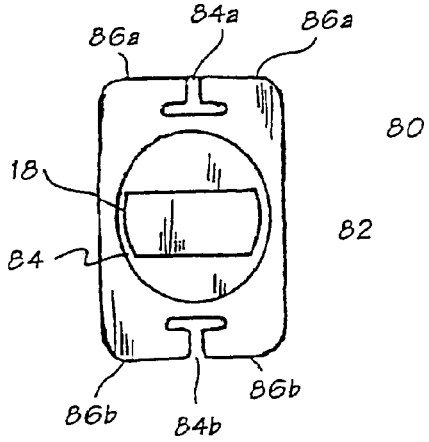

Additional golf ball position marker assemblies 70 and 80 are shown in FIGS. 4 and 5, respectively. Assembly 70 has a body 72, a magnetic insert 18 in a recess 74, and a clip 76. Assembly 80 has a body 82 with a recess 84 that holds a magnetic insert 18, and a pair of approximately "T"-shaped cutouts 84*a*, 84*b* positioned on opposing sides of body 82. The resulting projections 86*a*, 86*b* allow the user to attach assembly 80 to a belt loop or the like. In addition, projections 86*a*, 86*b* can be used in the manner of divot repair tools.

Magnetic insert 18 may be secured to base 16 by an adhesive, or may simply be press-fitted into position into a suitably-dimensioned recess (such as recess 26, FIG. 2A). As noted above, the shape and dimensions of insert 18 may vary considerably within the scope of the invention. Thus, assemblies 70 and 80 may include any of the inserts 18 described above, and such others as may be evident to those of ordinary skill in the art. Magnetic insert 18 may cover substantially all of the surface of base 16, or a part thereof if preferred Optionally, insert 18 may include a throughhole 32 for use with post-type ball markers.

Body 12 of assembly 10, and bodies 52, 72, 82 of assemblies 50, 70, 80, respectively, can be made of virtually any durable material, including metals, plastics (including clear plastics such as LUCITE and PLEXIGLAS), ceramics, and composite materials.

Figure 6:
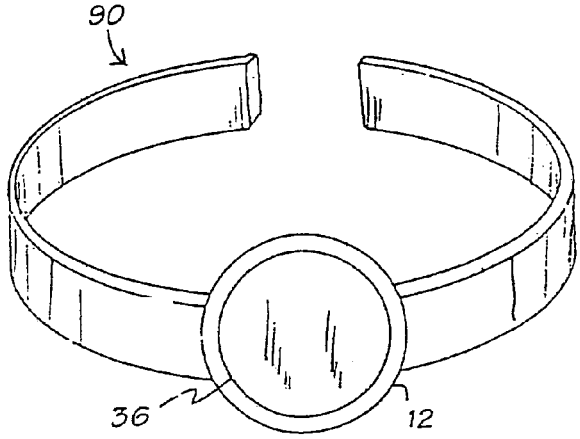
FIG. 6 is a perspective view of a bracelet according to the present invention.

A marking device according to the present invention can be used with other decorative and/or functional articles, including but not limited to accessories such as pendants, tie or collar pins, hat pins or hatband ornaments, belt buckles, bracelets, golf club shafts, binder clips, key rings, towel rings, divot tools, golf equipment, and so forth. For example, a bracelet 90, such as the bracelets favored by many athletes, may carry a ball marker 36 in a retainer such as body 12 (FIG. 6). Here, body 12 may be positioned anywhere convenient on bracelet 90, including the position shown in FIG. 6.

Figure 7:
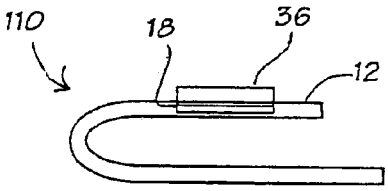
FIG. 7 is a side view of a belt clip according to the present intention.

In still another embodiment of the present invention, ball marker 36 can be secured to money clip such as 110 (FIG. 7). Clip 110 can be attached to wearable items such as a bracelet, wristband, hatband, waistband, or belt; alternatively, the clips can be used as money clips or be attached to a golf bag or golf cart. It will now be evident that an assembly according to the present invention may include a wide range of accessory articles in addition to those described above.

Figure 8:
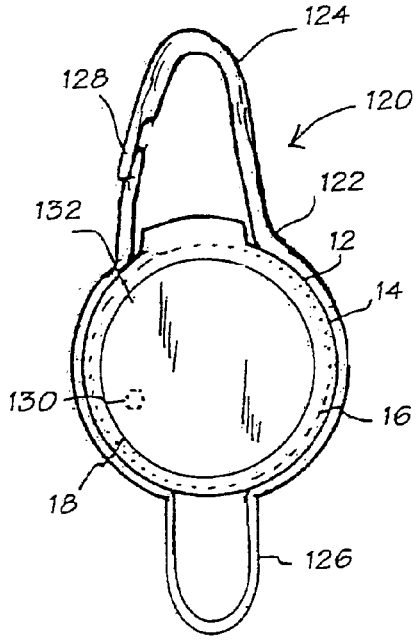
FIG. 8 is a front view of another marker assembly according to the invention.

Yet another embodiment of the present invention is shown in FIG. 8, which shows a golf ball position marker assembly 120 having a body 12 with a rim 14 about a base 16 (similar to above-described assembly 50), a magnetized or nonmagnetized insert 18, and a clip 122 fitted in a generally circumferential channel 58 about the perimeter of body 12. If desired, body 12 may include an optional enlarged portion 54 and a second recess 62 as described above. In a preferred embodiment, body 12 rotates freely on clip 122, limited only by portion 54 (if present).

Clip 122 has an upper portion 124 and a lower portion 126, generally as shown. One of portions 124, 126 may include a catch 128. Like clips 20 and 56, clip 122 is made of a somewhat springy, resilient material, preferably metal.

Body 12 in all embodiments of the invention may include a throughhole 130, a side slot 132, or both (FIG. 8). The user can remove a golf ball position marker from body 12 by inserting the tip end of a golf tee or other suitable object into throughhole 130 and pushing. If body 12 has a slot 132, the user can slide the marker from body 12 after removing clip 122, which serves as a retainer to hold the marker and body 12 together.

In use, assembly 120 may be carried in the user's pocket or may be attached to a golf bag, belt, or other accessory. Alternatively, assembly 120 can be used as a hanger for items such as towels, which can be inserted through one of portions 124, 126 while the other portion is hung on a hook, shower rod, or the like.

Figure 9:
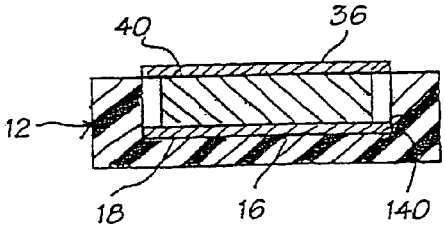
FIG. 9 is a cross-sectional view of another marker assembly according to the invention.

Still another embodiment of the invention is shown in FIG. 9, wherein body 12 has a recess 140 fitted with a metal disk 18. A removable magnet 40 at least partially covers disk 18; ball marker 36 is secured by magnet 40. Insert 18 may be press-fitted into recess 140, attached to the base by any suitable adhesive, or molded or assembled within the base. Magnet 40 can be of any suitable size, and that securely holds a ball marker. As noted above, magnet 40 may be coated on one or both sides with TEFLON™ or other suitable coating.

Figure 10A:
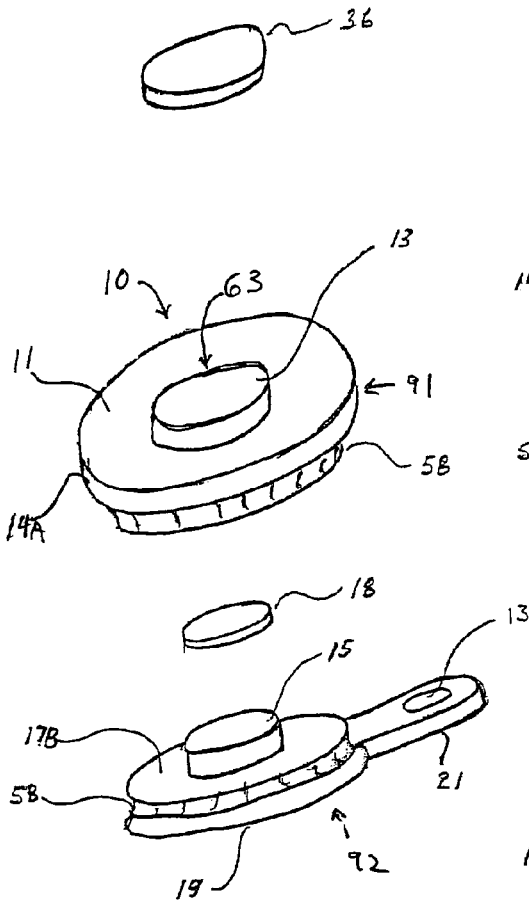
FIGS. 10A and 10B are perspective and cross-sectional views, respectively, of another embodiment of a marker assembly.
Figure 10B:
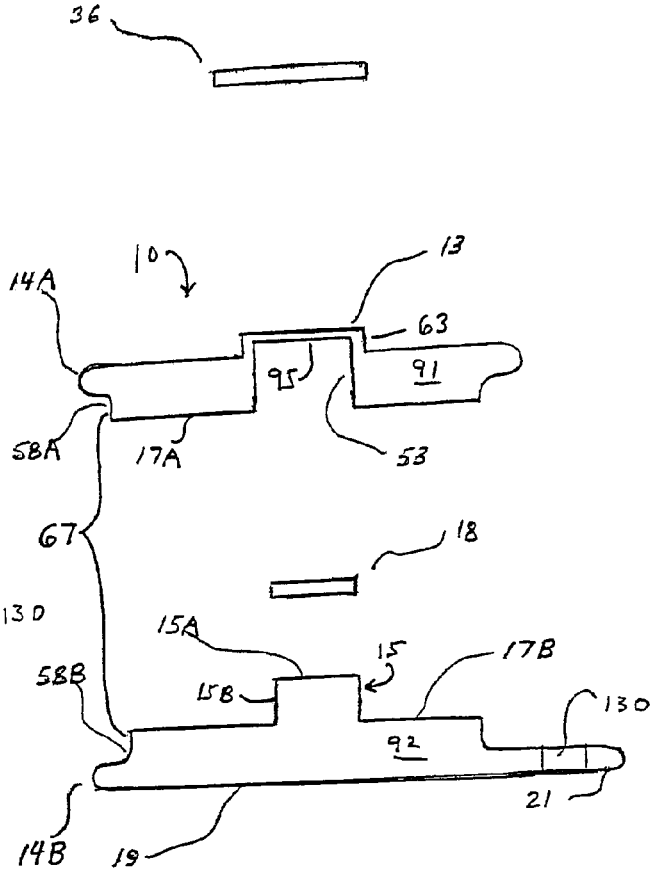

FIGS. 10A and 10B are perspective and cross-sectional views, respectively, of another embodiment of a marker assembly 10. The assembly has a top (or front) section 91, a bottom (or rear) section 92, and an insert 18. The top section 91 has a top surface 11, a support ledge or raised or protruding area 63 with a top surface area 13, a rim 14A, an inner surface 17A, an inner recessed cavity 53, a ceiling or end surface 95 of the cavity 53, and a support ledge 58A. The bottom section 92 has a rim 14B, an internal support 15 comprising a post 15B ending in a top surface 15A, an inner surface 17B, a back surface 19, a support ledge 58B, and a tab 21 having a through-hole 130. The insert 18, which may also be considered to be an attractor with respect to the marker 36, is in the cavity 53 and may be held there by any desired and appropriate means, such as, for example, by bonding it to the ceiling 95 or the ledge 15A by an adhesive, such as glue or epoxy, by a press-fit, or it may be simply held there by the internal support 15. The insert 18 may also be loose so that it can move around slightly in the space defined by area 53. The insert 18 may be a magnet, or a material attracted to a magnet, such as iron or steel. The marker 36 is made of a material that is attracted to the insert 18. For example, if the insert is a magnet, the marker may be a material attracted to a magnet or may also be a magnet. Conversely, if the insert 18 a material attracted to a magnet, then the marker 36 would be a magnet. The insert 18 thus holds the marker 36 on the surface 13 of the support 63. Of course, the insert 18 could also hold the marker 18 against the back surface 19. However, due to the cavity 53 and the internal support 15, the insert 18 is closer to the surface 13 than it is to the surface 19. Thus, marker 36 will preferentially be attracted to the surface 13. Further, the magnetic properties of the insert 18 may, if desired, be made sufficiently weak that the marker 36 is held only weakly to the surface 19 and easily dislodged, but is held reasonably firmly to the surface 13 so may still be conveniently dislodged when desired, such as to separate the marker 36 from the assembly 10 so that the marker can be placed in use. The magnetic attraction between the insert 18 and the marker 36 provides another advantage in that if the marker 36 is lying loose in the golfer's pocket, the assembly 10 can be manipulated or moved about in the golfer's pocket, either manually or by shaking the pocket, and the ball marker would secure itself onto the ledge 13.

The top section 91 and the bottom section 92 may be held together by any desired means, for example, adhesive, ultrasonic welding, mating parts, friction between the walls of cavity 53 and support 15, or other technique.

When the top section 91 and the bottom section 92 are held together the support ledges 58A, 58B and the rims 14A, 14B form a circumferential channel or groove 67, which may be used with a clip, for example, the clip 56 of FIG. 3A or the clip 122 of FIG. 8, to secure the assembly and the marker to the golfer's clothing or some other desired article, such as a golf bag. The clip 56 may be a custom clip or may be a readily-available article, such as a metal shower ring having a size and shape which match those of the body 12. The clip 56 should extend beyond the end of any tab 21 and/or should extend outward in another location with respect to the body 12 so as to provide a gap between the clip 56 and the body 12 for inclusion of part of the object to which the assembly is to be attached.

The tab 21 and the hole 130 also allow the assembly and the marker to be secured by a clip, cord, strap, ring, key ring, keychain, etc., to the golfer's clothing or other desired article. Although only one tab 21 is shown, there may be two or more tabs, if desired.

An assembly 12 having both the groove 67 with the clip 56 and the tab 21 with the hole 130 is extremely versatile and can be attached to and removed from most any desired object with minimal effort. Of course, the use of either the groove 67 or the tab 21 is optional.

Figure 11A:
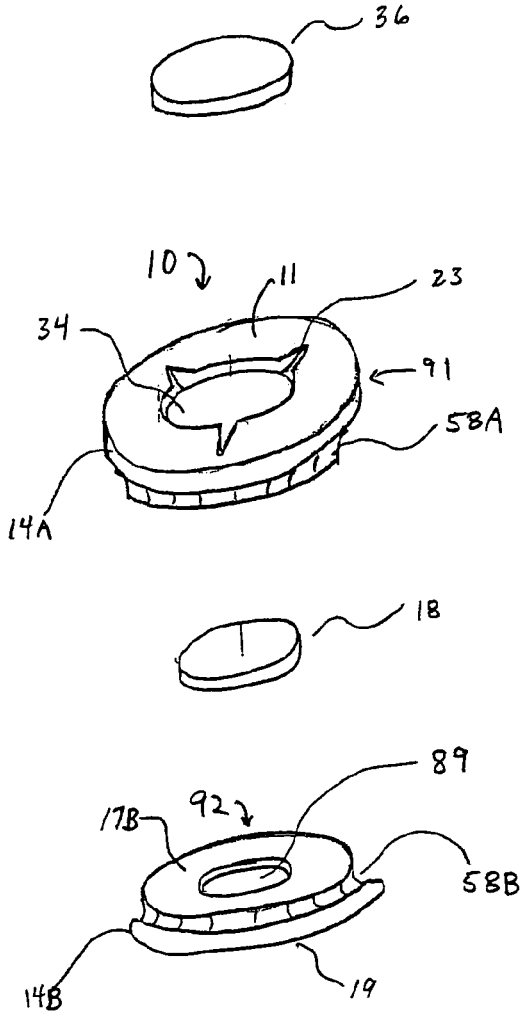
FIGS. 11A and 11B are perspective and cross-sectional views, respectively, of another embodiment of a marker assembly.
Figure 11B:
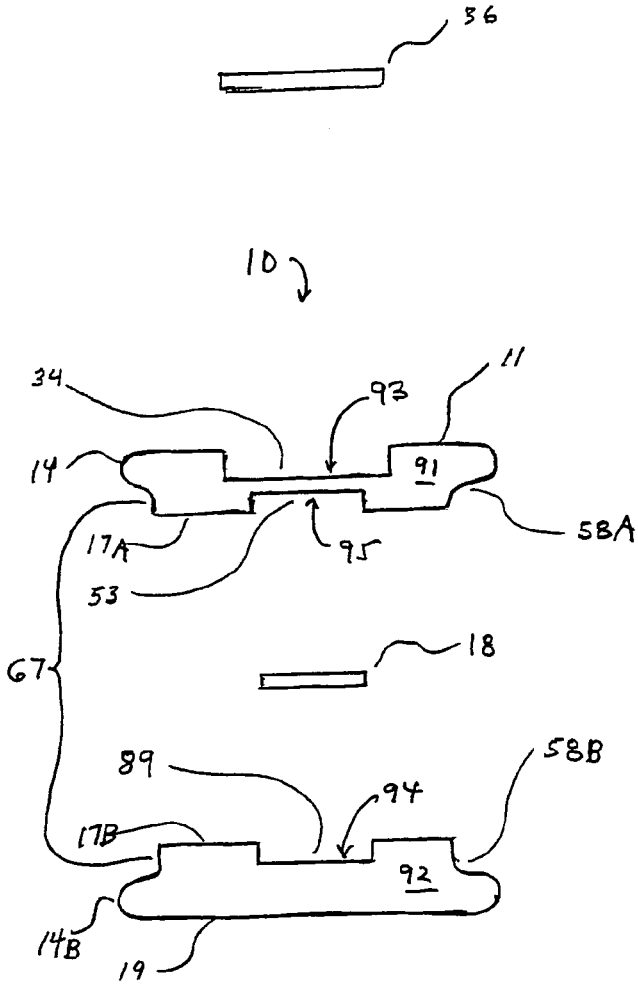

FIGS. 11A and 11B are perspective and cross-sectional views, respectively, of another embodiment of a marker assembly 10. This embodiment is somewhat similar to the embodiment of FIGS. 10A and 10B but differs in that the top section 91 has a recessed area 34 which has a floor 93, and the bottom section 92 has a recessed area 89 which has a floor 94. The insert 18 is enclosed in at least one of the two recessed areas 53, 89. If desired, the insert 18 may be held in place in one of the recessed areas by any desired and appropriate means. The insert 18 may also be loose so that it can move around in the area defined by areas 53, 89.

The recessed area 34 is sized to accommodate the marker 36. The size preferably, but not necessarily, matches the size of the marker 36 so that the top of the marker 36 is not above the top surface 11 to reduce the likelihood of inadvertent removal of the marker 36. To facilitate intentional removal of the marker 36, the top section 11 has several notches, depressions, or cutouts 23 so that an object may be inserted into a notch 23 to conveniently remove the marker 36. The size of a notch 23 will depend upon how it is intended to be used, for example, with a golf tee, a fingernail, a pen, a knife blade, or other suitable object. The notches 23 may all be the same, or may be different sizes and shapes, so as to accommodate different objects for removal of the marker 36.

Figure 12A:
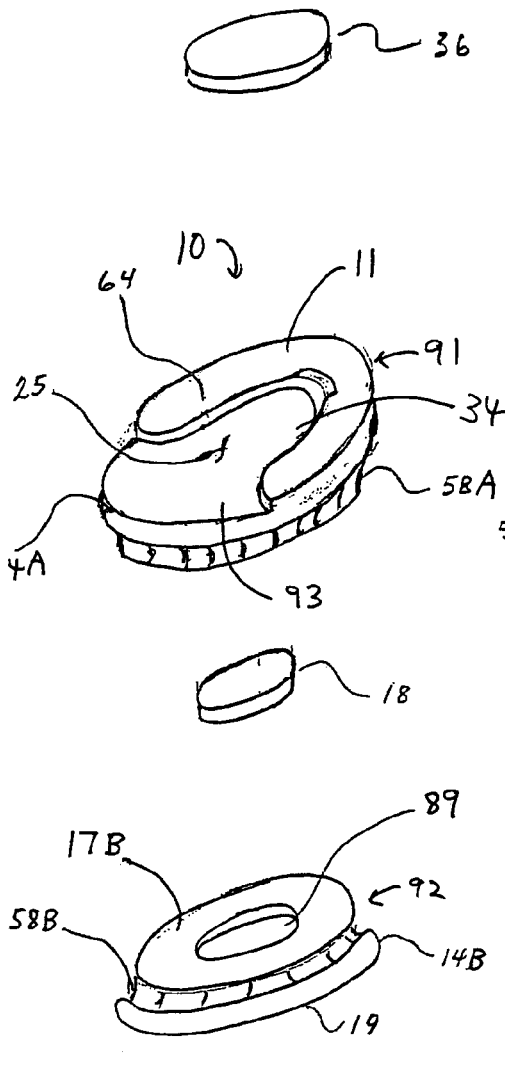
FIGS. 12A and 12B are perspective and cross-sectional views, respectively, of another embodiment of a marker assembly.
Figure 12B:
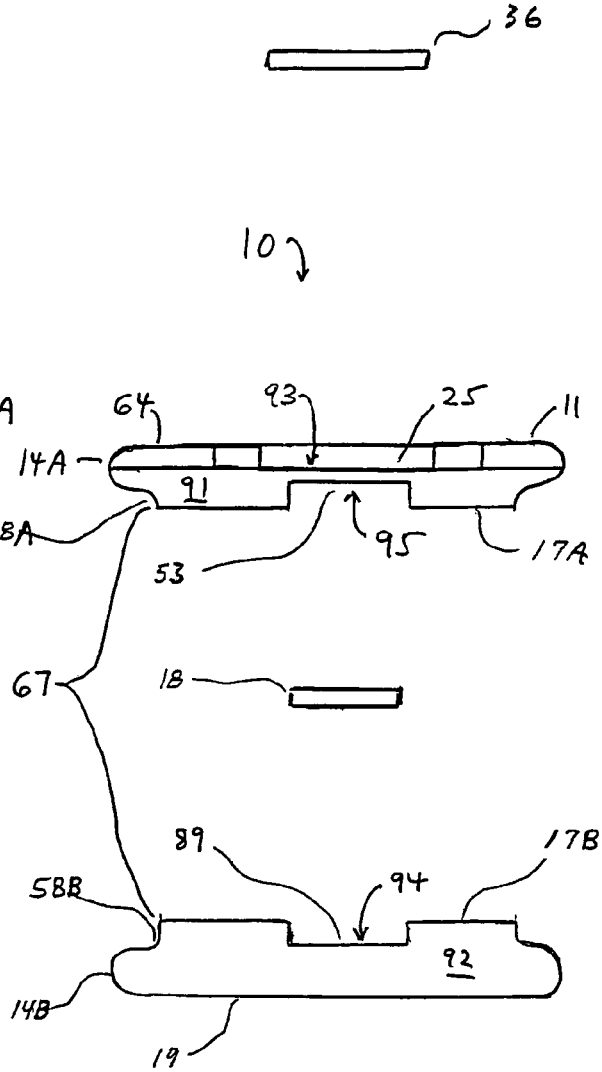

FIGS. 12A and 12B are perspective and cross-sectional views, respectively, of another embodiment of a marker assembly 10. This embodiment is somewhat similar to the embodiment of FIGS. 11A and 11B but differs in that the top section 91 has a portion removed so that the recessed area 34A and the floor 93 are not closed but are partly open. The top section 91 thus has a slotted area 25 which is formed by the shoulders 64 of the remaining recessed area 34A, and by the extended floor 93. The marker 36 may be conveniently slid into and out of the slotted area 25, and is held in place in the slotted area 25 by the underlying insert 18.

Figure 13A:
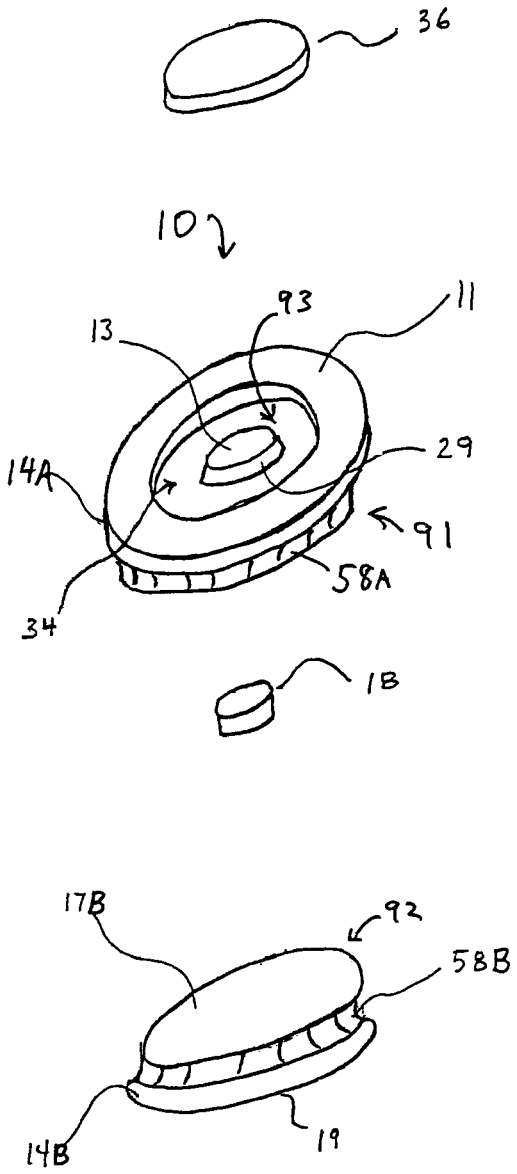
FIGS. 13A and 13B are perspective and cross-sectional views, respectively, of another embodiment of a marker assembly.
Figure 13B:
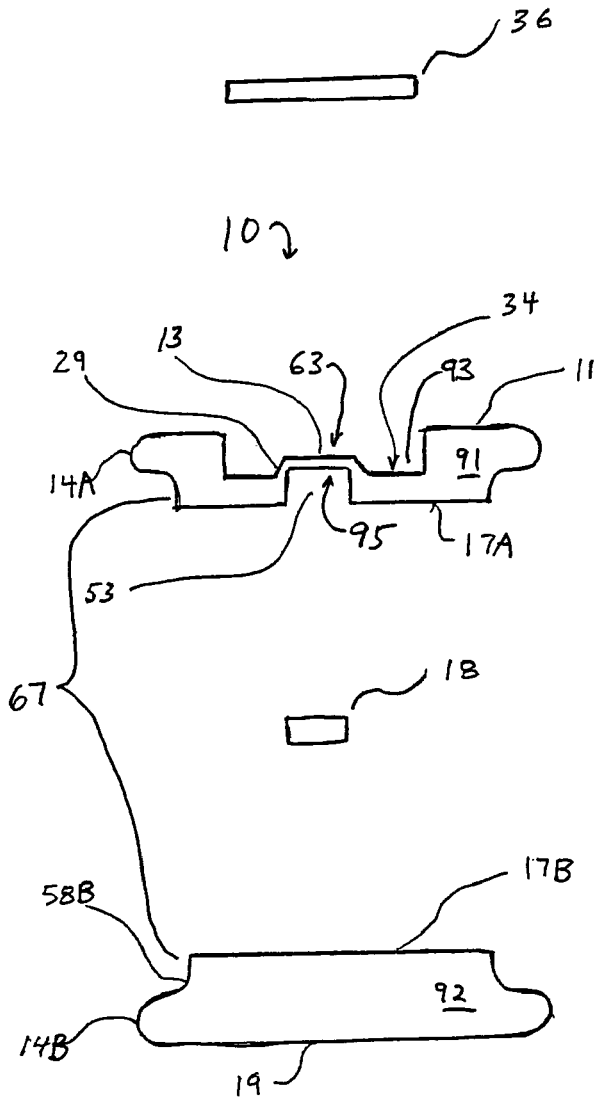

FIGS. 13A and 13B are perspective and cross-sectional views, respectively, of another embodiment of a marker assembly 10. This embodiment is somewhat similar to the embodiment of FIGS. 10A, 10B, 11A and 11B, but differs in that the bottom section 92 has neither an internal support 15 nor a recessed area 89, so the inner surface 17B is not discontinuous, and in that the top section 91 has the internal support 63 of FIGS. 10A and 10B, and both the recessed area 34 and floor 93 of FIGS. 11A and 11B. The internal support 63 is located within the recessed area 34 and, preferably, but not necessarily, has a chamfer or tapered sides 29. In this embodiment the marker 36 is held by the insert 18 against the surface 13 of the support 63 but above the floor 93. The marker 36 may be removed by pressing down on one side of the marker, which causes the marker 36 to pivot on the support 63 and raise the opposite edge, thereby allowing the marker 36 to be easily removed.

Figure 14A:
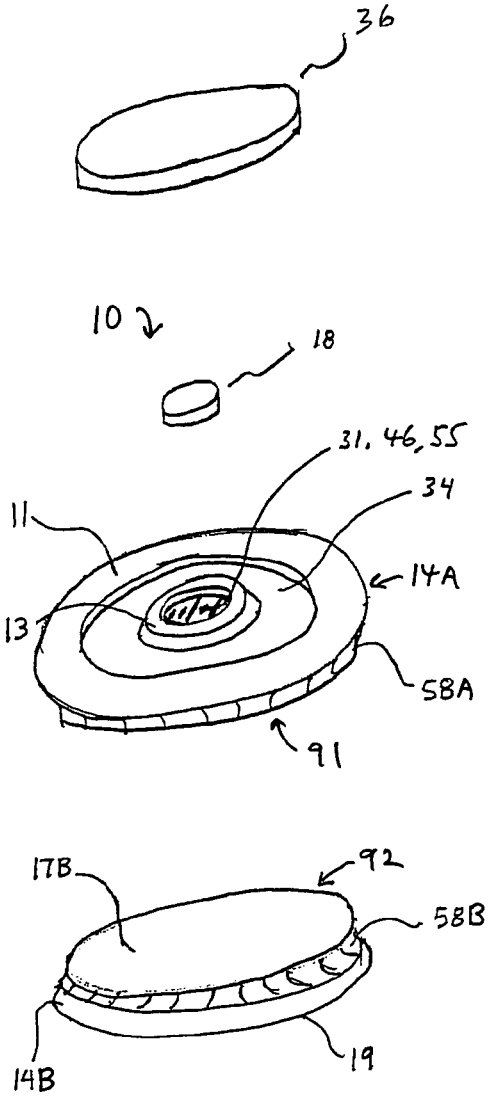
FIGS. 14A and 14B are perspective and cross-sectional views, respectively, of another embodiment of a marker assembly.
Figure 14B:
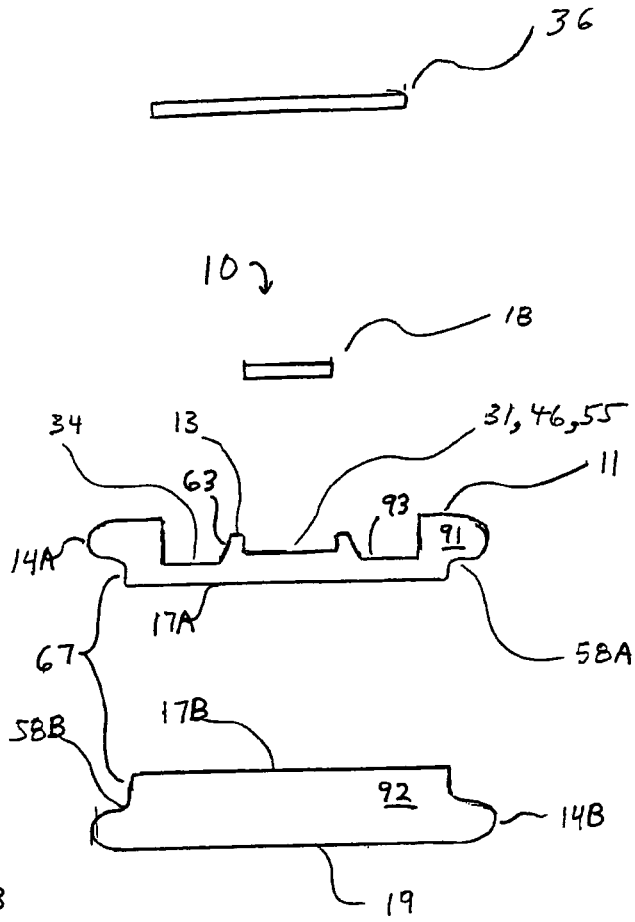

FIGS. 14A and 14B are perspective and cross-sectional views, respectively, of another embodiment of a marker assembly 10. This embodiment is somewhat similar to the embodiment of FIGS. 13A and 13B, but differs in that there is no recessed area 53. In this embodiment, the sections 91 and 92 may be two pieces which are bound together in any desired manner, or may be formed as a single piece. The top section 91 has the recessed area 34, the floor 93, and the support or pedestal 63, preferably but not necessarily with the chamfer or tapered sides 29. In addition, the support 63 has a recessed area 55 therein defined by the surface or shoulders 13, the recessed area 55 having a floor 46. In this embodiment the insert 18 is held in the recessed area 55 by any desired means. In this embodiment the marker 36 is held in the recessed area 34, and against the support 63 and/or the insert 18, by the magnetic attraction between the marker 36 and the insert 18. The marker 36 may be removed by pressing down on one side of the marker, which causes the marker 36 to pivot on the support 63 and raise the opposite edge, thereby allowing the marker 36 to be easily removed.

Figure 15A:
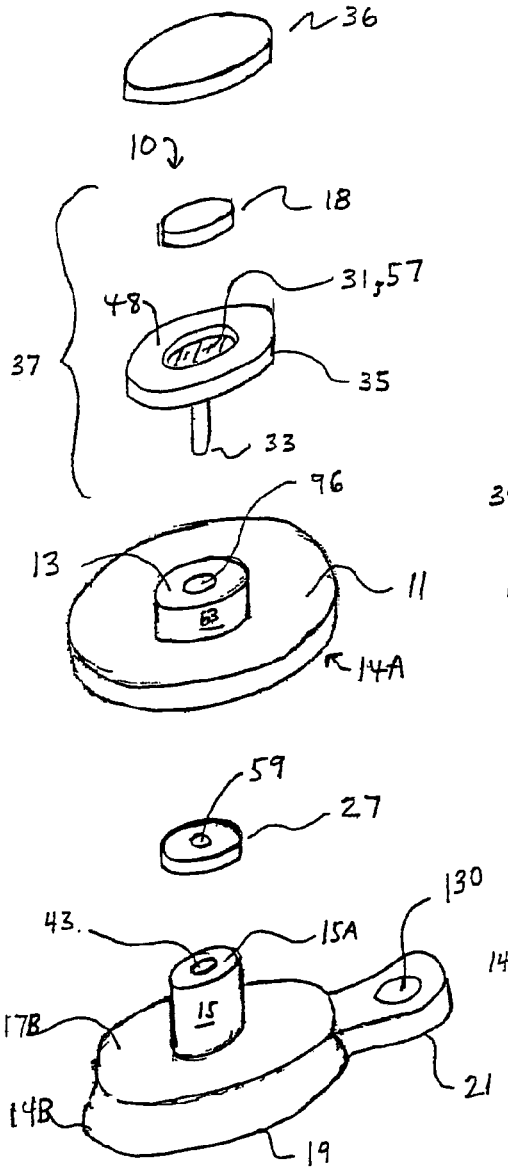
FIGS. 15A and 15B are perspective and cross-sectional views, respectively, of another embodiment of a marker assembly.
Figure 15B:
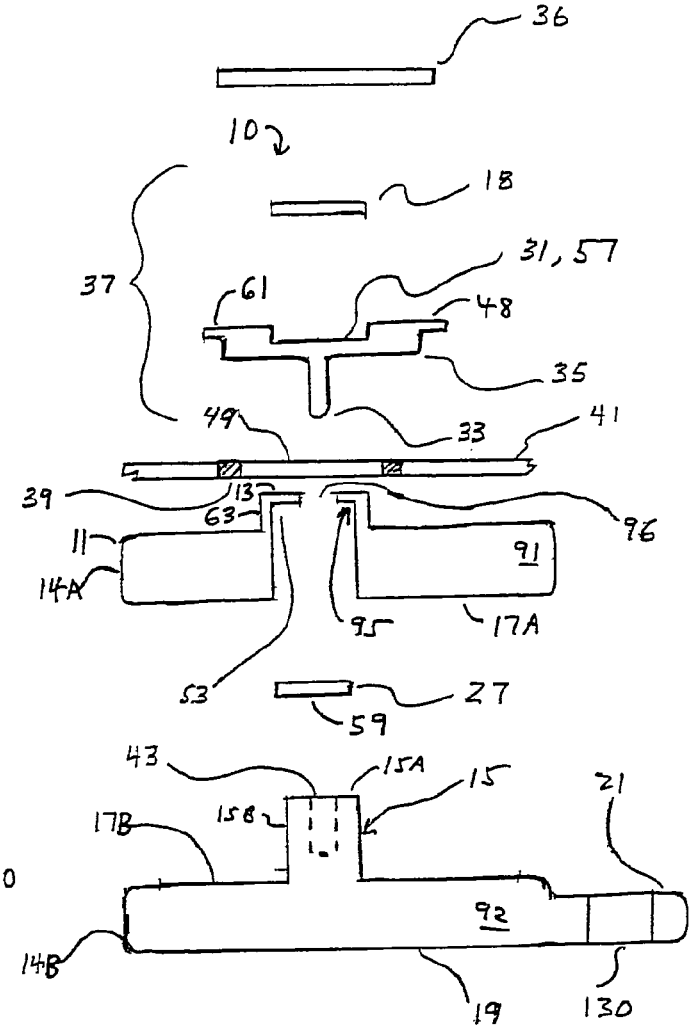

FIGS. 15A and 15B are perspective and cross-sectional views, respectively, of another embodiment of a marker assembly 10. The bottom section 92 is similar to that of FIGS. 10A and 10B but differs in that the internal support 15 has a hole 43 formed therein, and in that there may not be a ledge 58B around the rim 14B. The hole 43 may be a shallow hole or a though-hole, as desired. The top section 91 is similar to that of FIGS. 10A and 10B but differs in that there may not be a ledge 58A around the rim 14A, and in that the support 15, or the ceiling 95 of the recessed area 53, has a hole 96 formed therein. Also, in this embodiment, the object in the recessed area 53 is preferably not the insert 18, but is preferably a retainer 27 having a hole 59 defined through it. The retainer 27 may be a grommet, o-ring, washer, or other insert made of an appropriate material for the purpose described below. The retainer 27 may be, for example, rubber, wood, plastic, etc., and may be any desired and appropriate shape.

In this embodiment, the assembly also includes, or may be used with, a subcarrier 35, which has a post, peg, stem, or protrusion 33 extending from the bottom side, has a recessed area 57 in the top side, and may have an overhang or lip 61. The post 33 is removably insertable into the hole 96 of top section 14A, through the hole 59 of the retainer 27, and into the hole 43. The hole 43 need only be deep enough to accommodate the intended depth of penetration of the post 33. The subcarrier 35 is held in place by the retainer 27 gripping the post 33. Preferably, the subcarrier 35 is held in contact with the face 13 of the support 63. The recessed area 57 encompasses the insert 18. The insert 18 may be held in place in the recessed area 57 by any desired means 31. The subcarrier 35, means 31, and insert 18 may be considered to be a subcarrier assembly 37. Finally, the marker 36 is held in place by the insert 18. The marker 36 is preferably thus held against the face 48 of the subcarrier 35. This allows the marker 36 to be conveniently removed by using, for example, a finger to slide the marker 36 along the face 48, or by grabbing the marker 36 along its edges. However, if desired, the recessed area 57 may be sufficiently large that part or all of the marker 36 is within the recessed area, in which case the marker 36 may be removed by some other method, for example, prying it out.

Also shown in FIGS. 15A and 15B is a cross-sectional edge view of part of a carried object 41, such as a golf towel. Preferably, the height of the support 63 is at least as great as the depth of the carried object 41. In the embodiment shown, the carried object 41 has a hole 49 formed therein. If the carried object 41 is a golf towel then the hole 49 will be surrounded or defined by a metal or other grommet 39 sized to have an internal radius approximately equal to or larger than the external radius of the support 15. This allows the object 41 to be conveniently carried along with the marker 36. The object 41 may be used as is, or the assembly 37, including the marker 36, may be easily removed from the assembly 10 by simply pulling it away, thereby releasing the object 41 for other purposes, for example, to clean some other object which would be difficult to clean if the assemblies 10 and/or 37 were attached, or so that towel 41 can be washed. Although the embodiment shown herein does not have a groove 67, it may have the groove if desired. Likewise, although the other embodiments are shown as having a groove 67, it may be eliminated if desired.

Figure 16A:
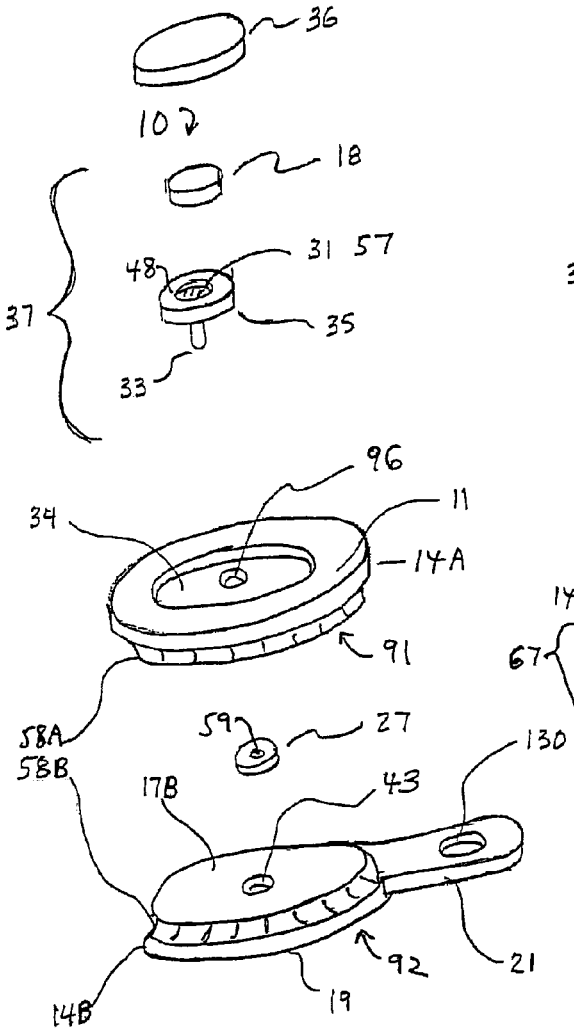
FIGS. 16A and 16B are perspective and cross-sectional views, respectively, of another embodiment of a marker assembly.
Figure 16B:
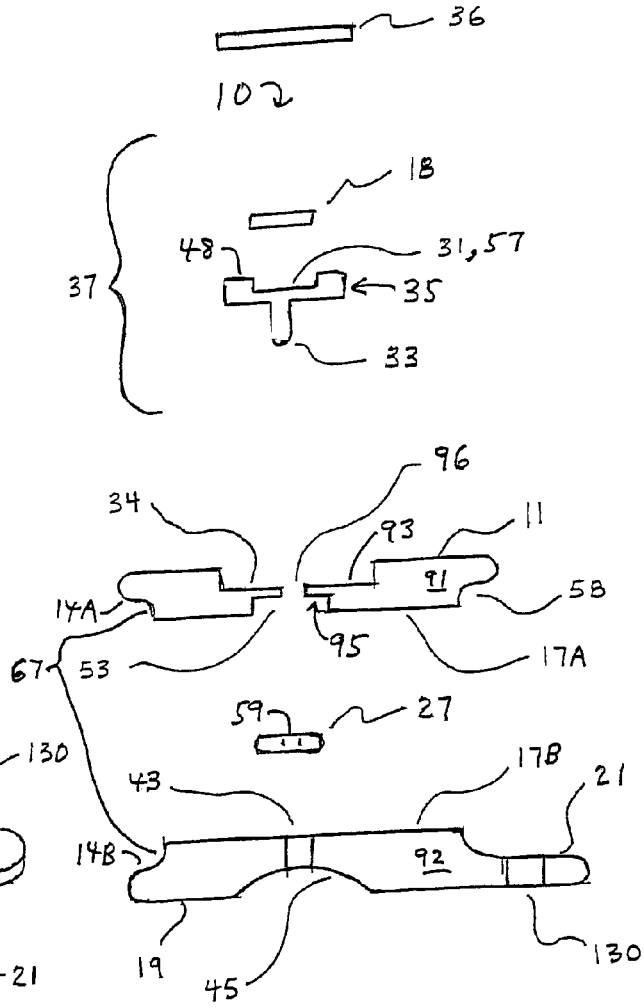

FIGS. 16A and 16B are perspective and cross-sectional views, respectively, of another embodiment of a marker assembly 10. The bottom section 92 is similar to that of FIGS. 10A and 10B but differs in that it does not have the internal support 15 of FIGS. 15A and 15B, but does have a hole 43 formed in the bottom section 92. The hole 43 may be a shallow hole or a though-hole, as desired. In addition, if desired, the bottom surface 19 may have a concave area 45 formed therein. The top section 14A is similar to that of FIGS. 11A and 11B but differs in that there is a hole 96 formed therein which connects recessed areas 34 and 53. Also shown are the subcarrier assembly 37 and the marker 36. The hole 96 is sized to conveniently accommodate the post 33 of the subcarrier 35. There is also a retainer 27 having a hole 59 defined therein, as in FIGS. 15A and 15B, which is preferably enclosed within the recessed area 53. The retainer 27 grips the post 33 so as to hold the subcarrier assembly 37 in place, partially or completely within the recessed area 34. The depth of the recessed area 34 may be selected to encompass, as desired, part of the subcarrier 35, all of the subcarrier 35 and part of the marker 36, or, preferably, all of both the subcarrier 35 and the marker 36. With the preferred depth, the top surface of the marker 36 is even with or below the top surface 11 of the top section 14A. The marker 36 is conveniently removed by pressing the end of the post 33 protruding from the bottom surface 19. This raises the subcarrier assembly 37 so that the marker 36 is above the surface 11, where it can be conveniently slid off or picked off the assembly 37. The marker 36 can also be removed by any other desired method.

If desired, the recess 34 may be made deep enough to hold two or more markers 36, limited primarily by the ability of the insert 18 to hold the markers in place in normal use.

It should be noted that it is not necessary to implement all of the various embodiments and aspects of the present invention to obtain some of the benefits of the present invention. The various aspects and embodiments thus may be used alone and/or combined, as desired.

Variations of the various embodiments of the present invention are also possible and will be suggested to those of skill in the art after reading the specification and inspecting the drawings. For example, the top section of one embodiment may be used with the bottom section of another embodiment, for example, the bottom section of FIGS. 10A and 10B may be used with the top section of FIGS. 11A and 11B. Further, two top sections may be used together without a bottom section, for example, two top sections in accordance with FIGS. 11A and 11B. Other combinations are also possible and contemplated, but, for brevity, are not listed here.

Also, with respect to FIGS. 15A, 15B, 16A, and 16B, the subcarrier 35 may, if desired, be a ball marker of the type which has a post 33 extending therefrom. In this case, the insert 18 would be part of the ball marker, and would preferably be a magnet, but could be a material that is attracted to a magnet, if an additional ball marker 36 is to be used. If an additional marker 36 is not being used then the insert 18 may be a non-magnetic material.

As will now be evident to those of ordinary skill in the art, the present invention contemplates a ball marker that can be removably secured to a variety of different decorative and/or functional articles. Other suitable articles for use with the invention include a binder clip, a key ring or towel ring, a padlock, and accessories such as a watch fob, a wristwatch, a pendant or charm, a belt slide, etc. If desired, a golf ball position marker assembly according to the invention may be equipped with other golfer's accessories such as divot repair tools and tee carriers.

In use, ball marker 36 is removed from assembly 10 (or other assembly according to the present invention) and placed in position on the putting surface of the green to mark the position of the user's ball. When it is time for the user to play, marker 36 is retrieved and re-attached to assembly 10, and the ball is placed on the green for play.

For some golfers, a golf ball position marker assembly according to the present invention may be a collectible item equivalent to golf logo balls and other golf-related collectibles. Many—perhaps most—people are collectors. Golfers in particular collect balls bearing the logos of famous golf clubs or golf courses, balls from courses they have played themselves, special-edition balls from tournaments, balls autographed by celebrities and champion golfers, and special balls such as those that have been used to play a hole-in-one.

The components of the invention can be made of virtually any convenient materials, including base and precious metals, ceramics, and durable plastics (LUCITE, PLEXIGLAS, and the like). The assembly may carry decorative or informational indicia such as precious stones, decorative designs, the user's name or initials, numbers, product brand names or trademarks, or golf club logos. It may include favorite jewels, coins, etc. that are removably installed in assembly 10 (or another assembly according to the invention) to serve as ball markers when so desired. Magnetized insert 18, when present, may be made of ferrous metal or other suitable materials, including rubber or plastic materials containing ferrous particles.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A golf ball position marking assembly, comprising:

a body having a top section, a bottom section attached to the top section, and an insert, the insert being at least one of a magnet or a magnetic material, the insert being enclosed by the top section and the bottom section; and a marker, the marker being at least one of a magnet or a magnetic material so as to be attracted to the insert, the marker being removably held against the body by the insert;

wherein the top section comprises a first surface, a second surface, the second surface being lower with respect to the first surface to form a recess, and a third surface being lower with respect to the first surface and being higher with respect to the second surface to form a ledge within the recess, the first, second and third surfaces being substantially in a same plane, and the marker being removably held at least partially within the recess and against the ledge by the insert.

2. A golf ball position marking assembly, comprising:

a body having a top section, a bottom section attached to the top section, and an insert, the insert being at least one of a magnet or a magnetic material, the insert being enclosed by the top section and the bottom section; and a marker, the marker being at least one of a magnet or a magnetic material so as to be attracted to the insert, the marker being removably held against the body by the insert;

wherein the top section comprises a first surface, a second surface, the second surface being lower with respect to the first surface to form a first recess, a third surface being lower with respect to the first surface and being higher with respect to the second surface to form a ledge within the first recess, and a second recess beneath the third surface, the first, second and third surfaces being substantially in a same plane, the insert being at least partially within the second recess, and the marker being removably held at least partially within the first recess and against the ledge by the insert.

* * * * *